US008132492B1

(12) United States Patent
Brum et al.

(10) Patent No.: US 8,132,492 B1
(45) Date of Patent: Mar. 13, 2012

(54) DISPENSING DEVICE FOR INFRARED SPECIAL MATERIAL

(75) Inventors: Roger D. Brum, San Juan Capistrano, CA (US); Mark A. Imhoof, Irvine, CA (US)

(73) Assignee: Meggitt Defense Systems, Irvine, CA (US)

( * ) Notice: Subject to any disclaimer, the term of this patent is extended or adjusted under 35 U.S.C. 154(b) by 480 days.

(21) Appl. No.: 12/367,710

(22) Filed: Feb. 9, 2009

(51) Int. Cl.
*F41F 5/00* (2006.01)

(52) U.S. Cl. ..... 89/1.54; 89/1.51; 102/505; 244/136; 221/222; 221/226; 221/231

(58) Field of Classification Search ..... 244/136, 244/137.1; 221/15, 222, 226, 221, 231; 102/502, 102/357, 336, 338, 342, 505; 89/1.54, 1.51, 89/1.58, 1.59
See application file for complete search history.

(56) References Cited

U.S. PATENT DOCUMENTS

| | | | |
|---|---|---|---|
| 2,381,130 | A | 8/1945 | Lloyd |
| 2,448,343 | A | 8/1948 | Solis |
| 2,551,596 | A | 5/1951 | Haglund |
| 2,813,719 | A | 11/1957 | Hopper |
| 2,907,536 | A | 10/1959 | Von Zborowki |
| 2,923,549 | A | 2/1960 | Hopper et al. |
| 2,953,377 | A | 9/1960 | Brust |
| 2,998,754 | A | 9/1961 | Bialy |
| 3,002,708 | A | 10/1961 | Wetzel et al. |

(Continued)

FOREIGN PATENT DOCUMENTS

DE 1229397 11/1966

(Continued)

OTHER PUBLICATIONS

Defense Electronics, "Expendable Decoys Counter Missiles With New Technology", Oct. 1986, vol. 18, No. 10, pp. 69-77.

*Primary Examiner* — Michael Carone
*Assistant Examiner* — Daniel Troy
(74) *Attorney, Agent, or Firm* — Stetina Brunda Garred & Brucker

(57) ABSTRACT

In accordance with the present invention, there is provided a deployment device that is operative to deploy Special Material (SM) to protect the vehicle when an enemy infrared (IR) threat is present. The deployment device constructed in accordance with the present invention comprises at least one, and preferably a pair of canisters which are each filled or loaded with SM, then factory sealed to prevent oxidation or contamination. Each of the canisters included in the deployment device includes an input shaft which, when rotated, is operative to transmit the rotary motion to each of four threaded rods. The rods have two primary functions, which are to advance a piston thereby preloading the SM within the canister toward the open end thereof, and to turn rotary metering devices which are located at the open end of the canister. The advancing piston maintains consistent compression in the SM stack within the canister. Additionally, the rotary metering devices which are located in respective ones of the four corners of the canister at the aft end thereof control and thus meter how the SM is dispensed into the airstream behind the aircraft. In this regard, the rotary metering devices have external features that interleave with the stack of SM. As the rotary metering devices turn, the interleaving features continuously release and engage the SM stack, thus controlling the distinct amount of SM released. When stationary, the rotary metering devices positively retain the SM stack within the canister.

5 Claims, 9 Drawing Sheets

U.S. PATENT DOCUMENTS

| | | | | |
|---|---|---|---|---|
| 3,095,814 | A | | 7/1963 | Jansen et al. |
| 3,135,511 | A | | 6/1964 | Norman et al. |
| 3,225,655 | A | | 12/1965 | Inglis |
| 3,410,559 | A | | 11/1968 | Miller, Jr. et al. |
| 3,505,926 | A | | 4/1970 | Johnson |
| 3,610,096 | A | | 10/1971 | Bauman et al. |
| 3,720,167 | A | | 3/1973 | Mainhardt et al. |
| 3,808,941 | A | | 5/1974 | Biggs |
| 3,871,321 | A | | 3/1975 | Giebel et al. |
| 3,898,661 | A | | 8/1975 | Kelly et al. |
| 3,899,975 | A | | 8/1975 | Lawrence |
| 4,062,112 | A | | 12/1977 | Lake |
| 4,140,433 | A | | 2/1979 | Eckel |
| 4,195,571 | A | | 4/1980 | Beeker et al. |
| 4,205,848 | A | | 6/1980 | Smith et al. |
| 4,406,227 | A | | 9/1983 | Beeker et al. |
| 4,428,583 | A | | 1/1984 | Feagle |
| 4,446,793 | A | | 5/1984 | Gibbs |
| 4,607,849 | A | | 8/1986 | Smith et al. |
| 4,621,579 | A | | 11/1986 | Badura et al. |
| 4,718,320 | A | | 1/1988 | Brum |
| 4,770,368 | A | | 9/1988 | Yates et al. |
| 4,796,536 | A | | 1/1989 | Yu et al. |
| 4,852,455 | A | | 8/1989 | Brum |
| 4,860,657 | A | | 8/1989 | Steinicker et al. |
| 4,899,662 | A | | 2/1990 | Santalucia et al. |
| 5,018,249 | A | * | 5/1991 | Andersson et al. ..... 221/222 |
| 5,074,216 | A | | 12/1991 | Dunne et al. |
| 5,179,778 | A | | 1/1993 | Dickson et al. |
| 5,249,924 | A | | 10/1993 | Brum |
| 5,445,078 | A | | 8/1995 | Marion |
| 5,499,582 | A | | 3/1996 | Schiessl et al. |
| 5,915,694 | A | | 6/1999 | Brum |
| 6,055,909 | A | | 5/2000 | Sweeny |
| 6,499,407 | B2 | | 12/2002 | Brum |
| 6,510,798 | B2 | * | 1/2003 | Brum ..... 102/505 |

FOREIGN PATENT DOCUMENTS

| | | |
|---|---|---|
| FR | 1336769 | 9/1963 |

* cited by examiner

DISPENSING DEVICE FOR INFRARED SPECIAL MATERIAL

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates generally to mission configurable infrared countermeasures for aircraft, and more particularly to a deployment device which accommodates infrared decoy foils within multiple canisters so as to allow for the control dispensing and dispersal of the foils. The infrared foils are typically a Special Material (SM) which, when brought into contact with air, become warm and radiate infrared energy.

2. Description of the Related Art

As is well known in the prior art, military aircraft are typically provided with countermeasures which are used to draw various types of guided weapons away from the aircraft. One common prior art countermeasure is a flare which is adapted to attract infrared or heat seeking guided missiles away from the deploying aircraft. In this respect, the flare is designed to present a larger thermal target than the aircraft from which it is deployed, thus attracting the weapon away from the aircraft.

With continuing advances in weapons technology, flares have become less effective as countermeasures due to anti-aircraft weaponry having become more sophisticated and provided with enhanced capabilities to discriminate between flares and the deploying aircraft. In this respect, modem heat seeking missiles are typically provided with both a spectral discriminator which is adapted to sense the peak intensity wavelength of the infrared signature of the aircraft and a kinetic discriminator which is adapted to sense the speed and trajectory at which the infrared signature is traveling. When a conventional flare is deployed from the aircraft, the infrared signature produced thereby is typically more intense in the near visible wavelength than that produced by the engines of the aircraft. In addition, the velocity and trajectory of the flare is significantly different than that of the deploying aircraft since the flare, once deployed, slows rapidly and falls toward the ground. The spectral discriminator of the guided missile is adapted to distinguish between the infrared signature produced by the flare and that produced by the engines of the aircraft. Additionally, the kinetic discriminator of the guided missile is adapted to distinguish between the velocity and trajectory of the aircraft and that of the flare, even if the spectral discriminator does not distinguish the infrared signatures produced thereby. As such, the combined functionality of the spectral and kinetic discriminators of the guided missile typically succeeds in causing the guided missile to disregard the deployed flare, and continue to target the aircraft.

In view of the above-described shortcomings of conventional flares, there has been developed in the prior art countermeasure systems which are adapted to create an infrared signature which is similar in magnitude or intensity to that produced by the aircraft engines, appears to travel at a velocity and trajectory commensurate to that of the aircraft, and can provide continuous protection while the aircraft is over threat territory. Examples of these prior art systems are shown and described in Applicant's U.S. Pat. Nos. 5,915,694 entitled DECOY UTILIZING INFRARED SPECIAL MATERIAL and 6,499,407 entitled PACKAGING METHOD FOR INFRARED SPECIAL MATERIAL, the disclosures of which are incorporated herein by reference.

These and other prior art references generally teach the dispensation of SM foils from an aircraft by stacking the SM foils in a canister and ejecting them either all at once using an explosive charge, or in small packets or continuously from a canister using a drive screw or similar device. The principle disadvantage of the all at once dispensation approach is that it provides only momentary protection in one intense cloud which does not follow the aircraft. This particular problem has been addressed by devices that dispense the SM foils approximately continuously such that the infrared cloud produced thereby appears to match the aircraft kinematics. Such continuous dispensation has been accomplished successfully in the prior art for relatively short stacks of SM foils through the use of a piston driven by a lead screw, and also by packaging the SM foils into small packets which engage a drive belt that drives them out of a corresponding canister.

However, in order to provide protection for an extended period of time, it is desirable to package the SM foils into canisters with more volume. While this can be accomplished by engaging individual packets of SM foils to a drive belt as described above, the method is more mechanically complex, less volume efficient and allows less flexibility in how the SM foils are dispensed than does a canister with a piston/lead screw. Unfortunately, the use of a piston/lead screw canister to facilitate the deployment of long columns of SM foils itself gives rise to certain problems. Existing piston/lead screw canisters typically comprise a hollow tube with a piston at one end, and spring fingers at the other. The SM foil stack is located between the piston and spring fingers. The purpose of the spring fingers is to retain the SM foils until such time as they are forced out of the canister by the piston. The stack of SM foils has a great deal of compliance. Since none of the SM foils are perfectly flat, the column acts as a spring. As the piston drives the SM foils out, the SM foil stack compresses against the spring fingers until they finally let go, at which time a large slug of SM foils is dispensed. This effect is minimal for short stacks of SM foils, but prevents controlled and uniform dispensing of long stacks of SM foils. The present invention, as will be described in more detail below, overcomes these and other deficiencies of the prior art.

BRIEF SUMMARY OF THE INVENTION

In accordance with the present invention, there is provided a deployment device that is operative to deploy Special Material (SM) to protect a vehicle when an enemy infrared (IR) threat is present. Commonly used on aircraft, SM protects the aircraft by moving its IR signature away from the host craft, thus protecting the aircraft (and crew) from missile attack. The deployment device constructed in accordance with the present invention comprises at least one, and preferably a pair of canisters which are each filled or loaded with SM, then factory sealed to prevent oxidation or contamination. Each canister can be stored for prolonged periods, and then installed into the deployment device when needed. As indicated above, one or more canisters can be included in the deployment device constructed in accordance with the present invention, with two canisters being provided in one embodiment thereof.

Each of the canisters included in the deployment device includes an input shaft which, when rotated, is operative to transmit the rotary motion to each of four threaded rods. The rods have two primary functions, which are to advance a piston within the canister toward the open end thereof, and to turn rotary metering devices (e.g., augers) which are located at the open end of the canister and cooperatively engaged to respective ones of the rods. The advancing piston maintains consistent compression in the SM stack within the canister. Additionally, the rotary metering devices which are located in respective ones of the four corners of the canister at the aft end thereof control and thus meter how the SM is dispensed into the airstream behind the aircraft. In this regard, the rotary metering devices have external features that interleave with the stack of SM. As the metering devices turn, the interleaving features continuously release and engage the SM stack, thus controlling the distinct amount of SM released. If the canister's input is turned rapidly, more material will be dispensed than if the input is turned slowly. When stationary, the metering devices positively retain the SM stack within the canister.

The present invention is best understood by reference to the following detailed description when read in conjunction with the accompanying drawings.

BRIEF DESCRIPTION OF THE DRAWINGS

These and other features of the present invention, will become more apparent upon reference to the drawings wherein.

Common reference numerals are used throughout the drawings and detailed description to indicate like elements.

DETAILED DESCRIPTION OF THE INVENTION

Figures 1, 1A:
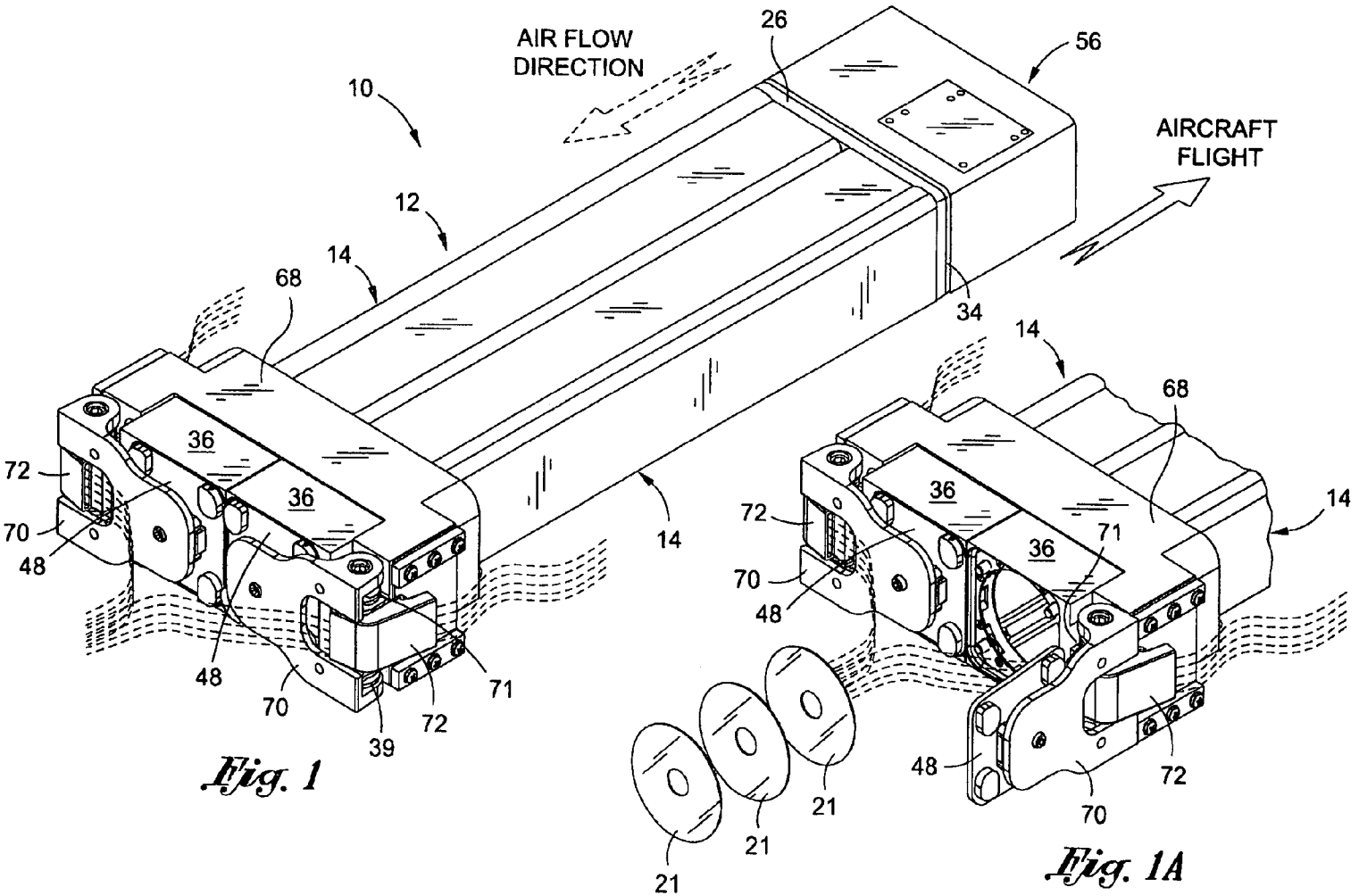
FIG. 1 is a rear perspective view of a deployment device constructed in accordance with the present invention, the deployment device being configured for installation on an aircraft (not shown), with the end caps of each of the cannisters of the deployment device being in a closed position.
FIG. 1A is a rear perspective view of the deployment device similar to FIG. 1, but depicting the end cap of one of the cannisters in an open position.
Figure 2:
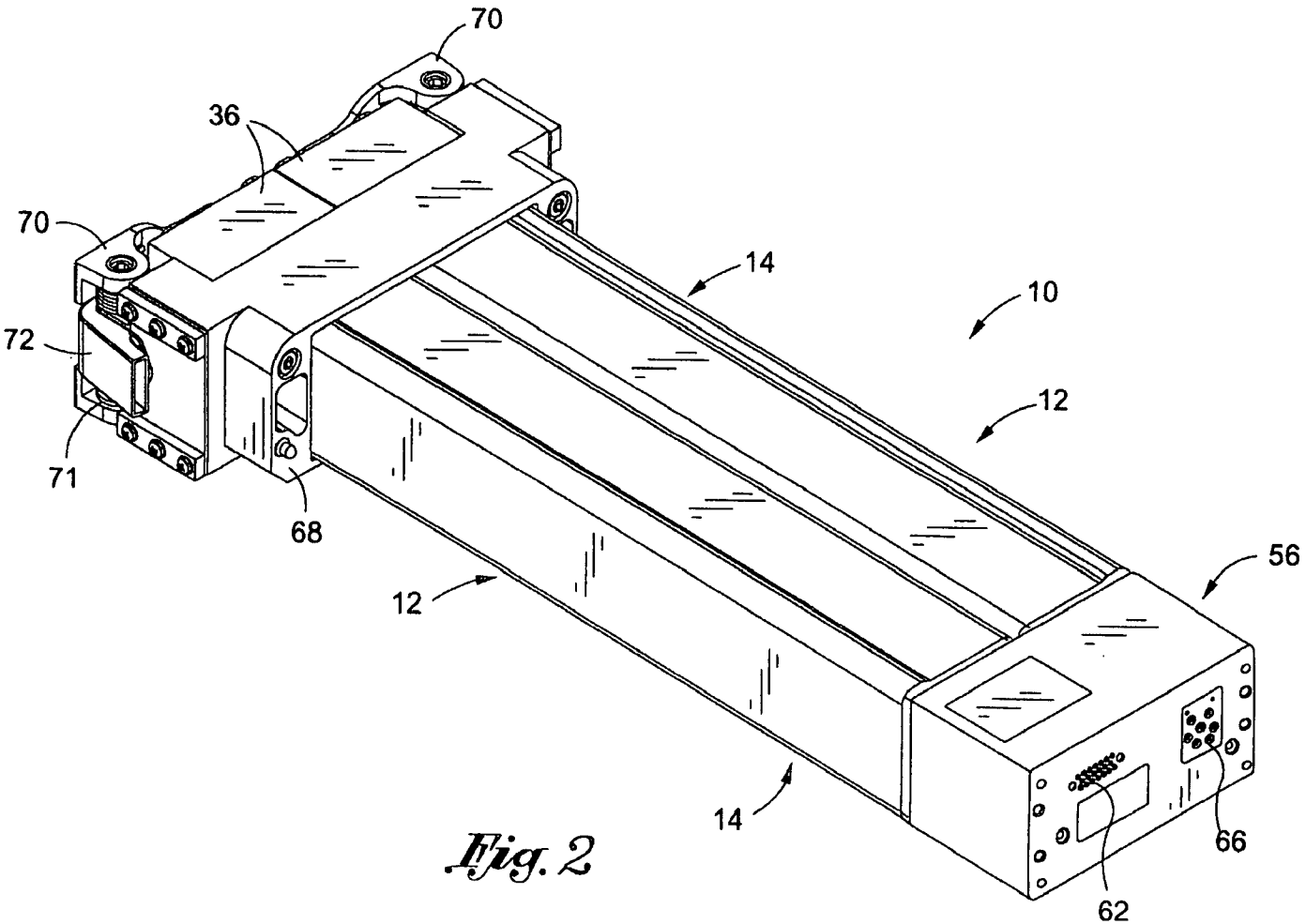
FIG. 2 is a front perspective view of the deployment device shown in FIG. 1.

Referring now to the drawings wherein the showings are for purposes of illustrating one exemplary embodiment of the present invention only, and not for purposes of limiting the same, FIGS. 1 and 2 perspectively illustrate an SM deployment device 10 constructed in accordance with the present invention. The deployment device 10, which is configured as a magazine, comprises an identically configured pair of elongate canisters 12 which extend in side-by-side relation to each other.

Referring now to FIGS. 3-7, each of the canisters 12 comprises an elongate housing 14 which has a generally quadrangular (e.g., square) external configuration. The housing 14 further defines a forward end 16 and an opposed aft end 18. As is apparent from FIGS. 6 and 7, the housing 14 has a tubular configuration, and defines an interior chamber 20 which has a generally circular cross-sectional configuration and extends longitudinally therethrough along an axis A. By way of example and not by way of limitation, the interior chamber 20 may have a length of approximately twenty (20) inches. In addition to the defining the interior chamber 20, the housing 14 also defines four elongate channels 22 which each extend along the length thereof in generally parallel relation to the axis A. Each of the channels 22 communicates with the interior chamber 20 and accommodates a drive mechanism component which will be described in more detail below. In the housing 14, the channels 22 are preferably separated from each other by intervals of approximately 90°.

Figure 5:
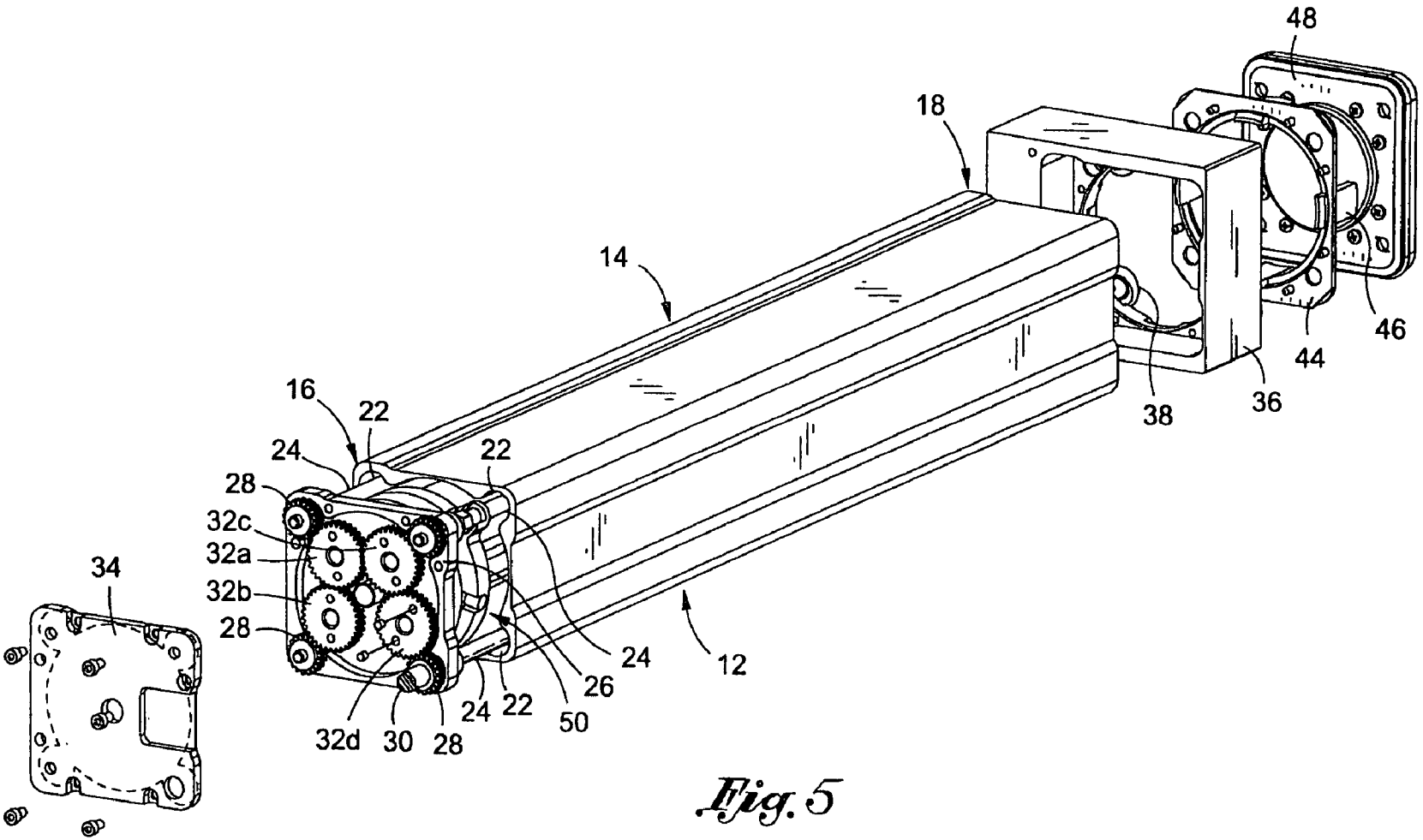
FIG. 5 is a front, exploded view of the canister shown in FIG. 3.
Figure 6:
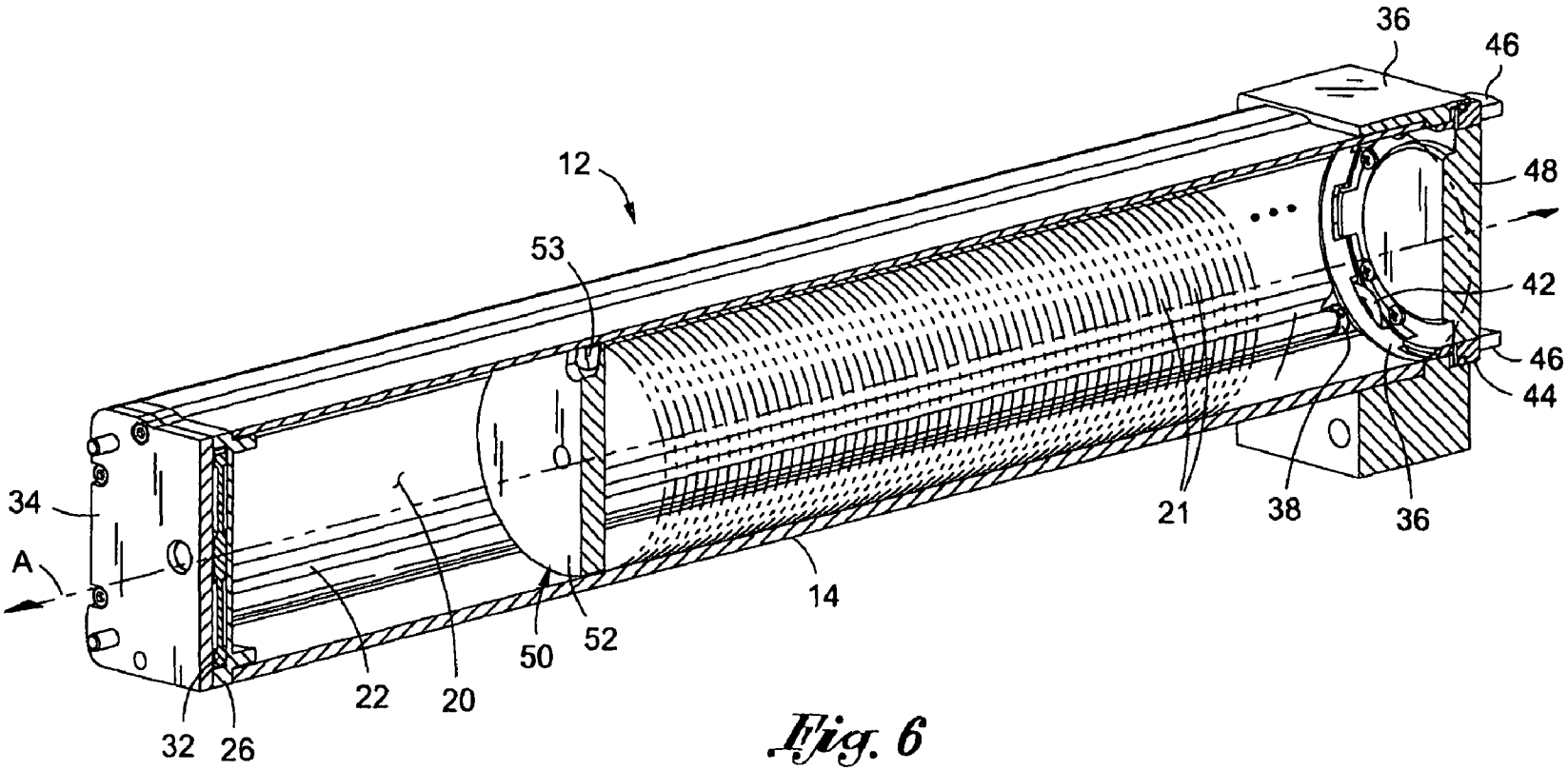
FIG. 6 is a cross-sectional view of the canister shown in FIG. 3, certain structural features of the canister, including the threaded rods thereof, being omitted for illustrative purposes.

In addition to the housing 14 each canister 12 of the deployment device 10 comprises a plurality of (e.g., four) elongate drive members, and more particularly threaded rods 24 which extend within respective ones of the channels 22. The length of each of the rods 24 exceeds that of the housing 14 such that opposed end portions of each of the rods 24 normally protrude from respective ones of the forward and aft end 16, 18 of the housing 14. As best seen in FIGS. 5 and 6, attached to the forward end 16 of the housing 14 is a generally quadrangular (e.g., square) base plate 26 having exterior contours which substantially mirror those of the housing 14. The base plate 26 includes apertures within each of the four corner regions defined thereby, such apertures accommodating respective ones of the rods 24 when the base plate 26 is attached to the forward end 16 of the housing 14. More particularly, when the base plate 26 is attached to the forward end 16, the peripheral surface of the base plate 26 is substantially flush or continuous with the outer surface of the housing 14. Additionally, the rods 24 extend through and are rotatable within respective ones of the four apertures included in each of the four corner regions of the base plate 26.

Figure 4:
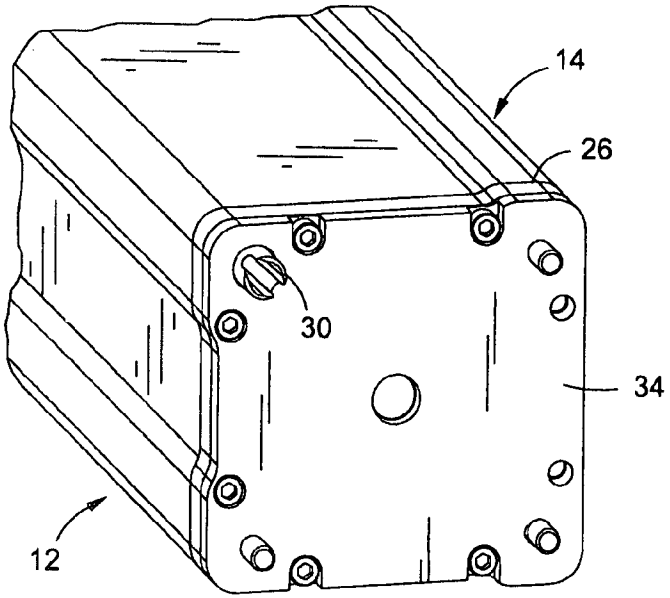
FIG. 4 is a partial front perspective view of the canister shown in FIG. 3.

As further seen in FIG. 5, cooperatively engaged to the end portion of each rod 24 protruding from the base plate 26 is a drive gear 28. Additionally, as seen in FIGS. 4 and 5, the distal end of one of the rods 24 includes a slot 30 which is formed therein and functions as a drive input. Cooperatively engaged to each of the drive gears 28 is a respective one of four (4) transmission gears 32*a*, 32*b*, 32*c*, 32*d* which are each rotatably mounted to the base plate 26 about the axis A. In addition to being intermeshed with respective ones of the drive gears 28, the transmission gears 32*a*-32*d* are innermeshed with each other in the manner shown in FIG. 5. As a result, the rotation of the rod 24 including the drive input (slot 30) facilitates the rotation of the drive gear 28 mounted thereto, which in turn facilitates the rotation of the transmission gears 32*a*-32*d*. The rotation of the transmission gears 32*a*-32*d* facilitates the simultaneous rotation of the remaining three drive gears 28, and hence the rods 24 to which they are mounted. Advantageously, due to the size and arrangement of the drive gears 28 and the transmission gears 32*a*-32*d*, each diametrically opposed pair of drive gears 28 (and hence the rods 24 to which they are mounted) will rotate in a first direction, with the remaining pair of diametrically opposed drive gears 28 (and hence the rods 24 to which they are mounted) rotating in a second direction which is opposite the first direction. These differing rotational directions provide advantages in the functionality of the deployement device 10 which will be described in more detail below. Further, the size and arrangement of the drive gears 28 and transmission gears 32*a*-32*d* results in the rotational speed of those rods 24 not including the drive input matching the rotational speed of the rod 24 including the drive input.

Within the canister 12, the drive gears 28 and transmission gears 32*a*-32*d* are covered or shielded by a quadrangular (e.g., square) end plate 34 which is mounted to the base plate 26. The exterior surface features or contours of the end plate 34 mirror those of the base plate 26 such that the peripheral surface of the end plate 34 is substantially flush or continuous with the peripheral surface of the base plate 26 and hence the outer surface of the housing 14 when the end plate 34 is mounted to the base plate 26, as is shown in FIG. 4. As is also apparent from FIG. 4, the end portion of the rod 24 including the drive input protrudes from the outer surface of the end plate 34, thus completely exposing the slot 30.

Figure 7A:
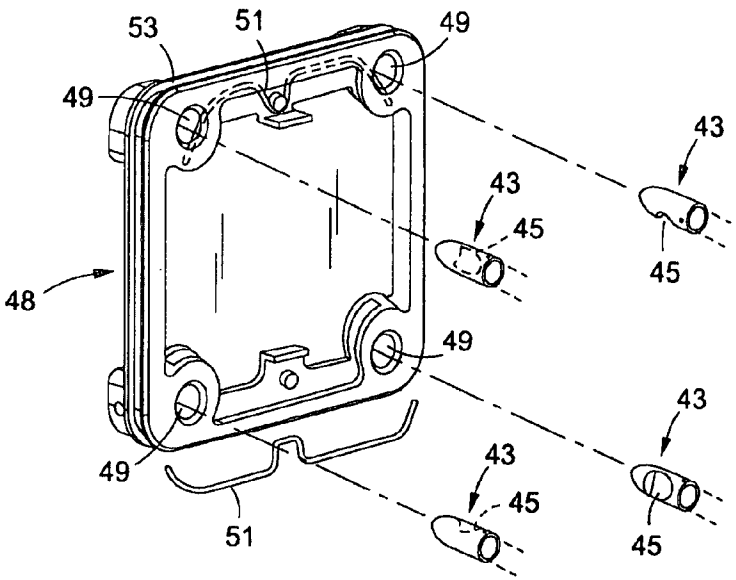
FIG. 7A is a perspective view of the end cap of the cannister shown in FIG. 3, illustrating the structural features of the end cap which facilitate the releasable attachment thereof to the threaded rods of the cannister.
Figure 7:
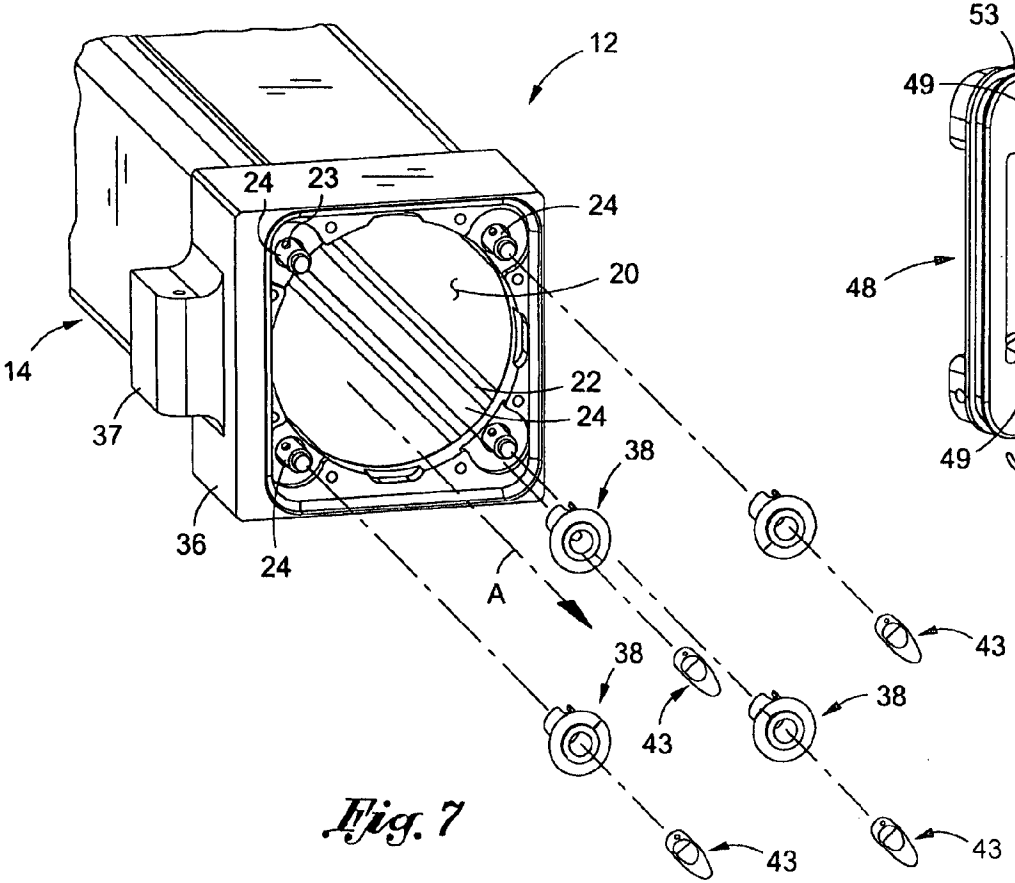
FIG. 7 is a partial exploded view of the canister shown in FIG. 3, illustrating the rotary metering devices and latch members which are operatively coupled to each of the threaded rods thereof.

Referring now to FIGS. 5-7, each canister 12 further comprises a generally quadrangular (e.g., square) support frame 36 which is attached to the aft end 18 of the housing 14. As best seen in FIG. 7, the support frame 36 defines a circularly configured central opening which is positioned along the axis A and substantially coaxially aligned with the interior chamber 20 when the support frame 36 is attached to the housing 14. In addition to the central opening, the support frame 36 includes four apertures within respective ones of four corner regions defined thereby, each of these apertures accommodating respective ones of the rods 24. In this regard, when the support frame 36 is attached to the aft end 18 of the housing 14, end portions of the rods 24 protrude from the support frame 36, and are rotatably accommodated by respective ones of the apertures therein. The end portions of the rods 24 protruding from the support frame 36 each preferably include a pin 23 disposed therein and protruding radially therefrom. The use of the pins 23 of the rods 24 will be discussed in more detail below. The support frame 36 also includes an exterior hinge portion 37, the use of which will also be discussed below.

Figure 8:
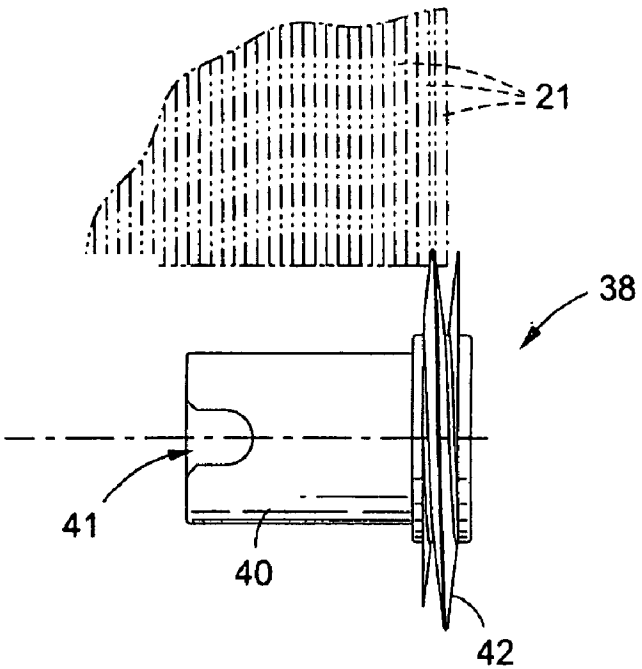
FIG. 8 is a side elevational view of one of the rotary metering devices shown in FIG. 7.

As further seen in FIG. 7, mounted to the end portion of each rod 24 protruding from the support frame 36 is a rotary metering device 38. In FIG. 7 and FIG. 8 (where it is shown individually), the rotary metering device 38 is in the form of an auger. In this regard, each rotary metering device (auger) 38 comprises a tubular main body 40 which is sized and configured to be advanceable over the exposed end portion of a respective rod 24. Formed in the distal end of the main body 40 of each rotary metering device 38 is a slot 41 which is sized and configured to receive or accommodate the pin 23 of the corresponding rod 24. In this regard, the receipt of the pin 23 of each rod 24 into the complimentary slot 41 of the corresponding rotary metering device 38 ensures that the rod 24 and the rotary metering device 38 will rotate concurrently with each other. Formed about and protruding radially from one end portion of the main body 40 is a spiral blade 42. The use of the rotary metering devices 38, and in particular the blades 42 thereof, will be discussed in more detail below.

As also seen in FIG. 7, advanced over and secured to the exposed end portion of each rod 24 of the canister 12 is a latch member 43. In this regard, as is apparent from FIG. 7, the blade 42 of each rotary metering device 38 is positioned between the support frame 36 and a respective one of the latch members 43. Each of the four latch members 43 included with the canister 12 is configured to be advanceable over a reduced diameter distal end portion of a respective rod 24, and secured thereto via the advancement of a pin through coaxially aligned apertures disposed within the distal end portion of the rod 24 and the latch member 43. Further, each latch member 43 includes a notch 45 formed therein, the use of which will also be discussed in more detail below.

Mounted to the support frame 36 of each canister 12 is a support plate 44 which, like the support frame 36, defines a circularly configured central opening which is positioned along the axis A. In this regard, when the support plate 44 is attached to the support frame 36, the central opening of the support plate 44, the central opening of the support frame 36, and the interior chamber 20, which are each of substantially equal diameter, are coaxially aligned with each other. In addition to the central opening, the support plate 46 also includes four apertures disposed in within respective ones of the four corner regions defined thereby, these apertures also rotatably accommodating the end portions of respective ones of the rods 24. As seen in FIG. 5, the support plate 44 may also include four guide tabs 46 which are positioned about the central opening thereof in equidistantly spaced intervals of approximately 90°. The use of the guide tabs 46 will be described in more detail below. When the support plate 44 is attached to the support frame 36, the rotary metering devices 38 are partially captured therebetween. More particularly, the rotary metering devices 38 are positioned between the support frame 36 and the support plate 44 such that a portion of the blade 42 of each rotary metering device 38 protrudes radially toward the axis A from a respective one of four slots which are collectively defined by the support frame 36 and the support plate 44, each such slot communicating with the central opening of the support frame 36. However, the latch members 43 are disposed outward of the support plate 44.

Figure 3:
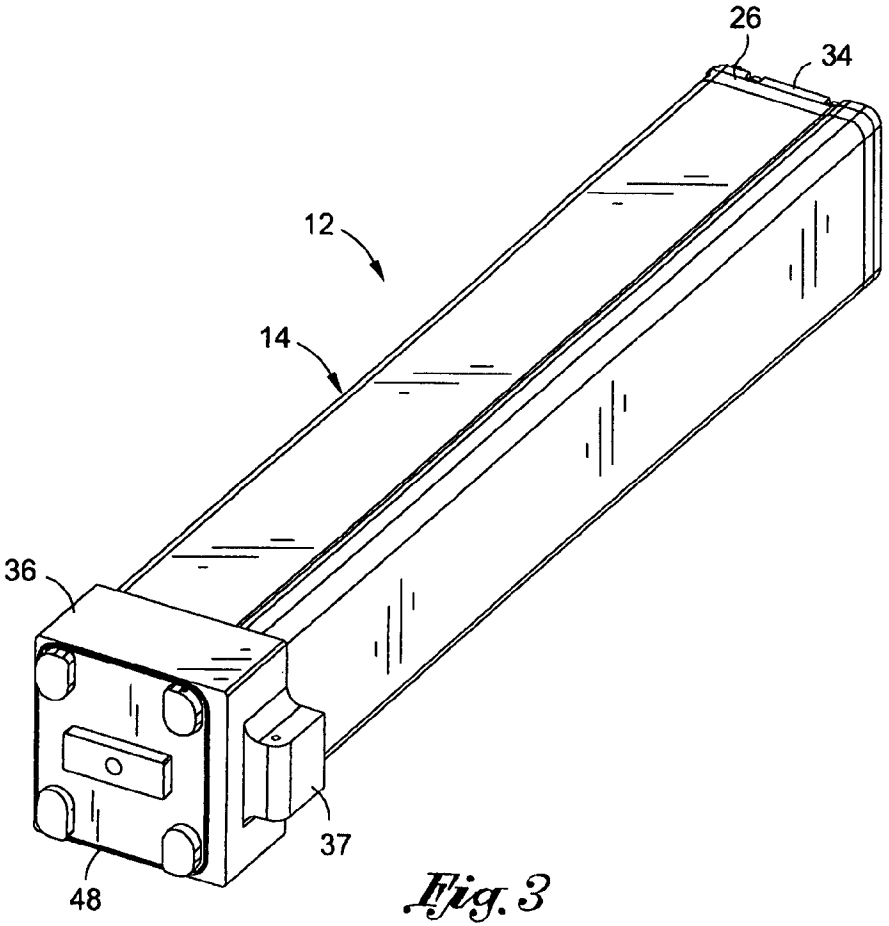
FIG. 3 is a rear perspective view of one of the canisters included in the deployment device shown in FIGS. 1, 1A and 2.

As seen in FIGS. 1 and 3, the central opening of the support plate 44, and hence the open end of the interior chamber 20 at the aft end 18 of the housing 14, is enclosed by an end cap 48. As will be discussed in more detail below, the end cap 48 is selectively moveable between a closed position (shown in FIGS. 1 and 3) and an open position (shown in FIG. 1A) wherein the end cap 48 is rotated or pivoted to assume an angular orientation of about 90° relative to the position shown in FIGS. 1 and 3. As shown in FIG. 7A, the end cap 48 has a generally quadrangular configuration and defines inner and outer surfaces. The end cap 48 includes four circularly configured openings 49 disposed in respective ones of the four corner regions defined by the inner surface thereof. The end cap 48 also includes a pair of springs 51 which are attached thereto in spaced relation to each other. Each of the springs 51 includes an opposed pair of resiliant end portions which are exposed in respective ones of a corresponding pair of the openings 49. The springs 51 are adapted to interact with the latch members 43 of the corresponding canister 12 in a manner maintaining the end cap 48 in its closed position, as will be described in more detail below. It is contemplated that the end cap 48 may also be provided with an O-ring seal 53 which effectively prevents the leakage of air into the interior chamber 20 of the canister 12 when the end cap 48 is in its closed position.

Figure 9:
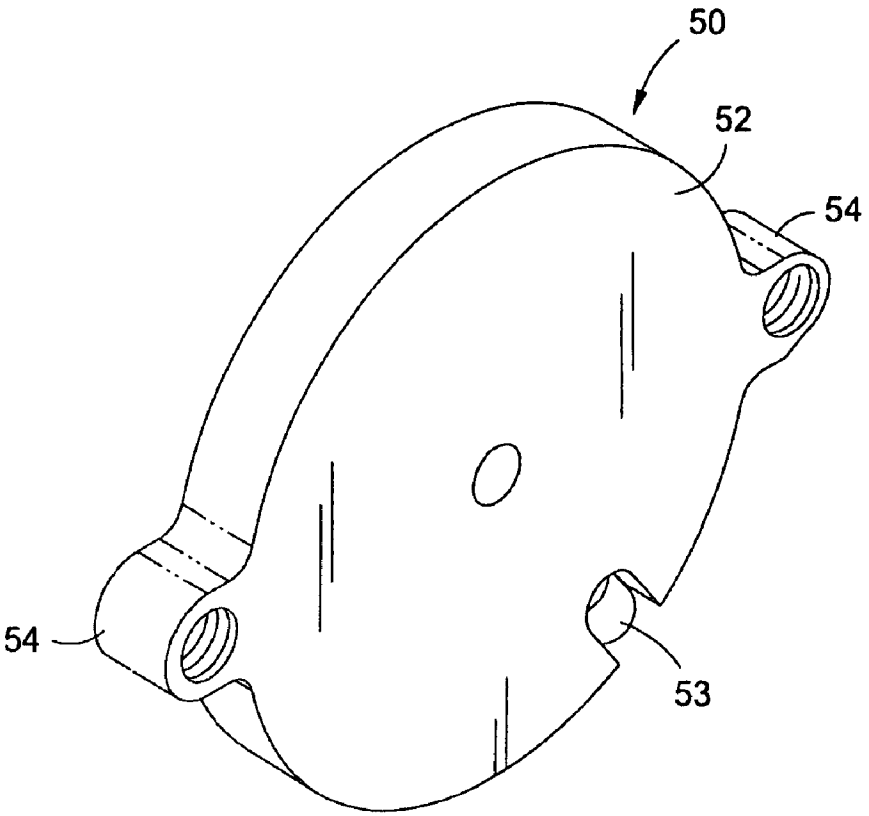
FIG. 9 is a perspective view of the piston included in each of the canisters of the deployment device.

Referring now to FIG. 9, each canister 12 further comprises a circularly configured piston 50 which is cooperatively engageable to at least two of the rods 24 so as to be moveable axially within the interior chamber 20 along the axis A upon the concurrent rotation of the rods 24. As seen in FIG. 9, the piston 50 comprises a circular main body 52 having a diameter which is substantially equal to, but slightly less than, the diameter of the interior chamber 20. Optionally disposed within a peripheral portion of the main body 52 is a magnet 53. In addition to the main body 52, the piston 50 includes a pair of ears 54 which are integrally connected to the main body 52 and are diametrically opposed, i.e., separated from each other by approximately 180°. The ears 54 are sized and configured to be advanceable into respective ones of a corresponding, diametrically opposed pair of the channels 22. Additionally, each of the ears 54 includes an internally threaded opening which is sized and configured to threadably engage a respective one of the rods 24. More particularly, the ears 54 (and hence the piston 50) are cooperatively engaged to a diametrically opposed pair of the rods 24 which, as indicated above, will rotate in the same direction. As will be recognized by those of ordinary skill in the art, due to the threaded engagement of the piston 50 to a diametrically opposed pair of the rods 24, the concurrent rotation of such rods 24, which act as drive screws, facilitates the movement of the piston 50 within the interior chamber 20 along the axis A. In preparing the deployment device 10 of the present invention for use, the piston 50 within each canister 12 will reside within the interior chamber 20 of the housing 14 adjacent the base plate 26 at the forward end 16 of the housing 14. During use of the deployment device 10, as will be described in more detail below, the piston 50 will move along the axis A toward the aft end 18 of the housing 14.

Figure 10:
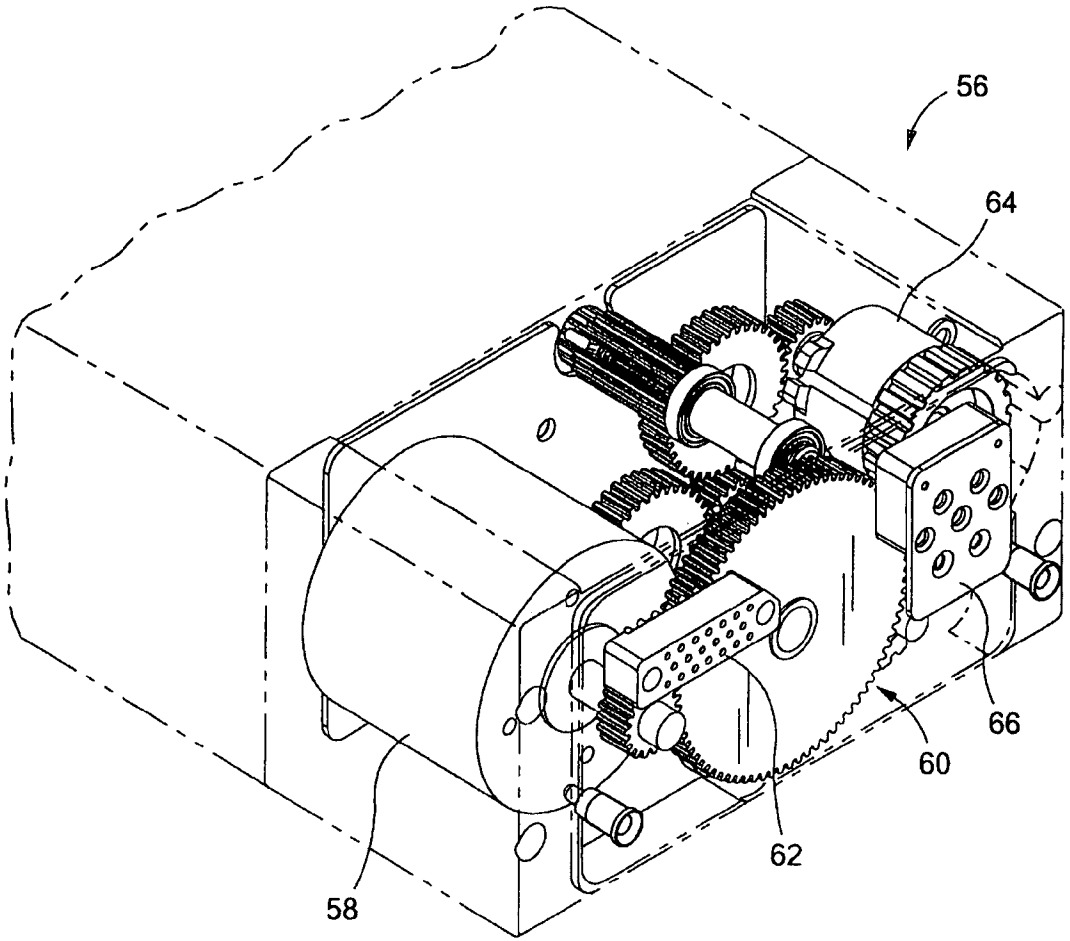
FIG. 10 is a perspective view of the drive unit of the deployment device, the exterior housing of the drive device being omitted for illustrative purposes.

As is apparent from the foregoing, the axial movement of the piston 50 of each canister 12 is dependent upon the concurrent rotation of the rods 24 thereof, which is itself dependent upon a rotary input force being applied to the rod 24 defining the drive input and including the slot 30. In the deployment device 10, a rotary input force is exerted upon those rods 24 of the two canisters 12 defining the drive inputs by a drive unit 56 which is attached to the end caps 48 of the side-by-side canisters 12. As seen in FIG. 10, the drive unit 56 comprises a drive motor 58 which is mechanically coupled to those rods 24 of the canisters 12 defining the drive inputs by a gear train or transmission 60. Such coupling is facilitated, in part, by the advancement of drive structures of the gear train into respective ones of the slots 30. Electrical power is provided to the drive motor 58 by a power connector 62 of the drive unit 56. The drive unit 56 also includes an electrically controlled clutch 64 which is cooperatively engaged to the gear train 60 and is operative to regulate the rotational speed of the rods 24, in addition to providing an output indicative of the position of the piston 50 of each canister 12 relative to the housing 14 thereof. The output indicative of the position of the piston 50 of each canister 12 may be transmitted from the deployment device 10 by a signal connector 66 of the drive unit 56. The signal connector 66 is also operative to accept input signals which facilitate the control of the drive unit 56, and hence the deployment device 10. Those of ordinary skill in the art will recognize that the drive unit 56 is operative to facilitate the rotation of the rods 24 defining the drive inputs of the canisters 12 one at a time, or simultaneously, depending on the desired functionality of the deployment device 10.

In the deployment device 10 constructed in accordance with the present invention, each of the canisters 12 are advanced through a mainframe 68, with that end or face of each support frame 36 disposed furthest from the end cap 48 being abutted against one side or face of the mainframe 68, as best shown in FIG. 1. Rotatably connected to the hinge portion 37 of each support frame 36 is a hinge member 70, a portion of which is also rigidly attached to a respective one of the end caps 48. The movement of each end cap 48 between its open and closed positions is facilitated by the pivotal movement of the corresponding hinge member 70 relative to the hinge portion 37 to which it is pivotally connected. As seen in FIG. 1A, a biasing spring 71 is cooperatively engaged to each hinge member 70 and a corresponding one of the hinge portions 37. Each biasing spring 71 is operative to normally bias the corresponding end cap 48 toward its open position as shown in FIG. 1A. In this regard, each biasing spring 71 is operative to facilitate the pivotal movement of the corresponding end cap 48 from its closed position to its open position upon the end cap 48 being effectively released or disengaged from the latch members 43 of the corresponding canister 12, as will be described in more detail below.

In the deployement device 10, each end cap 48 is maintained in its closed position by the cooperative engagement of the latch members 43 of the corresponding canister 12 to the springs 51 of the end cap 48. More particularly, when compressive pressure is applied to the end cap 48 at a level sufficient to overcome the biasing force exerted thereon by the corresponding biasing spring 71, the end cap 48 is pivoted from its open position (shown in FIG. 1A) to its closed position (shown in FIG. 1). The movement of the end cap 48 to its closed position facilitates the insertion or advancement of the latch members 43 of the corresponding canister 12 into respective ones of the openings 49. The advancement of the latch members 43 into the openings 49 results in the resilient end portions of the springs 51 being inserted into respective ones of the notches 45 of the latch members 43. The cooperative engagement between the springs 51 and the latch members 45 effectively maintains the end cap 48 in its closed position.

As indicated above, the concurrent rotation of the rods 24 facilitates the movement of the piston 50 within the interior chamber 20 of the corresponding canister 12 along the axis A. In the deployment device 10, the initial rotation of each of the rods 24 (and hence each of the latch members 43) at an initial interval of approximately 120° facilitates the removal of the resilient end portions of each spring 51 from within the notches 45 of the corresponding pair of latch members 43. As will be recognized by those of ordinary skill in the art, the disengagement of the springs 51 of the end cap 48 from the latch members 43 of the corresponding canister 12 allows the end cap 48 to "spring" from its closed position to its open position as a result of the biasing force exerted thereon by the corresponding biasing spring 71 and intervening hinge member 70. As will further be recognized by those of ordinary skill in the art, once the end cap 48 actuates to its open position, the return thereof to the closed position is effectuated by pushing the end cap 48 as needed to overcome the biasing force exerted by the biasing spring 71 and facilitate the reinsertion of the latch members 43 into respective ones of the openings 49, the latch members 43 thereafter being rotated as needed to facilitate the reinsertion of the resilient end portions of the springs 51 of the end cap 48 into respective ones of the notches 45 of the latch members 43.

As best seen in FIGS. 1 and 1A, in addition to the hinge member 70, also attached to the hinge portion 37 of each support frame 36 is an air scoop 72. Each air scoop 72 is fixedly mounted to a corresponding support frame 36. Additionally, as is apparent from FIGS. 1 and 1A, each air scoop 72 is specifically configured so as to be operative to effectively direct air flow moving along the airflow direction arrow of FIG. 1 (which is opposite the aircraft flight direction arrow of FIG. 1) to a point immediately behind or aft the deployment device 10. Advantageously, each air scoop 72 is partially accommodated by a complimentary slot within the corresponding hinge member 70 such that the redirected air flow path created by the air scoop 72 is essentially unaffected by the movement of the corresponding end cap 48 from its closed position to its open position.

The completely assembled deployment device 10 as shown in FIGS. 1, 1A and 2 is specifically sized and configured (i.e., has a form factor) for operative engagement to the existing ALE-50 infrastructure of an F-16 military aircraft. However, those of ordinary skill in the art will recognize that deployment devices comprising one or more of the above-described canisters 12 provided in arrangements differing from that described in relation to the deployment device 10 are contemplated to be within the spirit and scope of the present invention.

Having thus described the structural attributes of the deployment device 10, one particular mode of operation will now be discussed. Each canister 12 of the deployment device 10 is prepared by loading a stack of SM foils 21 into the interior chamber 20 thereof. As explained above, each canister 12, after being filled or loaded with the SM foils 21, is factory sealed to prevent oxidation or contamination. Individual canisters 12 may be stored for prolonged periods, then assembled into the deployment device 10 when needed. Each of the SM foils 21 has a generally round or circular shape, and is stacked into the interior chamber 20 of each canister 12 aft of the piston 50.

When the deployment device 10, including the side-by-side canisters 12, is operatively positioned on an aircraft, the use of the deployment device 10 is initiated by activating the drive unit 56 in a manner facilitating the pivotal movement of one or both of the end caps 48 from the closed position to the open position. As indicated above, each end cap 48 is moved from the closed position to the open position by initiating the rotation of the rods 24 of the corresponding canister 12 in an amount sufficient to facilitate the disengagment or release of the springs 51 of the end cap 48 from with the notches 45 of the latch members 43 attached to the rods 24. Such release or disengagement allows the biasing force exerted upon the end cap 48 by the corresponding biasing spring 71 via the intervening hinge member 70 to facilitate the pivotal movement of the end cap 48 to its open position. The rotation of the rods 24 of each canister 12 is facilitated by the application of a rotary input force to that rod 24 of the canister 12 which defines the drive input thereof. As indicated above, such input force is supplied by the drive unit 56 which is mechanically coupled to those rods 24 of the canisters 12 which define the drive inputs.

When the rod 24 of the canister 12 defining the drive input is rotated, the rotary motion is transmitted to the remaining three rods 24 via the transmission gears 32*a*-32*d* in the above-described manner. As also explained above, the concurrent rotation of all four threaded rods 24 at an initial increment of approximately 120° facilitates the movement of the end cap 48 of the canister 12 from its closed position to its open position. The continued rotation of all four threaded rods 24 after the opening of the end cap 48 facilitates the advancement of the piston 50 from its original position adjacent the forward end 16 of the housing 16 toward the aft end 18 thereof. The rotation of the rods 24 also facilitates the concurrent rotation of the rotary metering devices 38 cooperatively engaged thereto. The advancing piston 50 maintains constant compression in the stack of SM foils 21 previously loaded into the interior chamber 20 of the canister 12. Advantageously, the rotary metering devices 38 control and thus meter how the SM foils 21 are dispensed into the air stream behind the aircraft. More particularly, the blades 42 of the rotary metering devices 38 which protrude into the central opening of the support frame 36 of the canister 12 as described above interleave with the stack of SM foils 21. As a result, as the rotary metering devices 38 rotate, the interleaving features defined by the blades 42 thereof continuously release and engage the stack of SM foils 21, and effectively control the distinct amount of SM foils 21 released from the canister 12. If the rod 24 defining the drive input of the canister 12 is turned rapidly, more of the SM foils 21 will be dispensed then if such rod 24 is turned slowly. When the rods 24 are stationary, the rotary metering devices 38 function to positively retain the stack of SM foils 21. Thus, the rotary metering devices 38 effectively function as displacment control devices, with every turn of the rod 24 defining the drive input facilitating the release of a discreet amount of the SM foils 21 from the canister 12.

As indicated above, a diametrically opposed pair of the rotary metering devices 38 rotate in a first (clockwise) direction, with the rotary metering devices 38 of the remaining diametrically opposed pair rotating in a second (counterclockwise) direction. Importantly, these differing rotational directions effectively prevent the rotary metering devices 38 from actually rotating the stack of SM foils 21 as they rotate, which could otherwise occur if all four rotary metering devices 38 rotate in the same direction. As shown in FIG. 1A, once the SM foils 21 are ejected from within the corresponding canister 12 as a result of the rotation of the rotary metering devices 38, the SM foils 21 are further effectively dissipated by the impingement of the redirected air stream thereagainst, as is facilitated by the air scoops 72 of the deployment device 10. In this regard, the redirected air stream facilitates the separation and dispersal of the SM foils 21.

Figure 12:
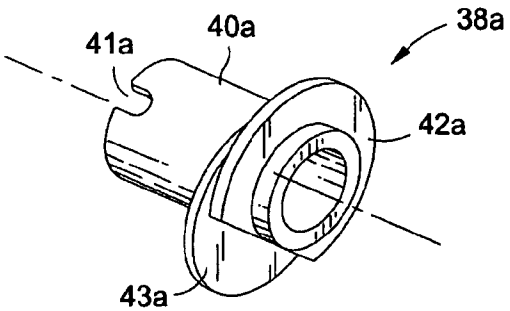
FIG. 12 is a front perspective view of the rotary metering device shown in FIG. 11.
Figure 14:
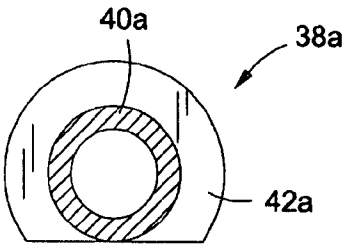
FIG. 14 is a cross-sectional view taken along line 14-14 of FIG. 11.
Figure 11:
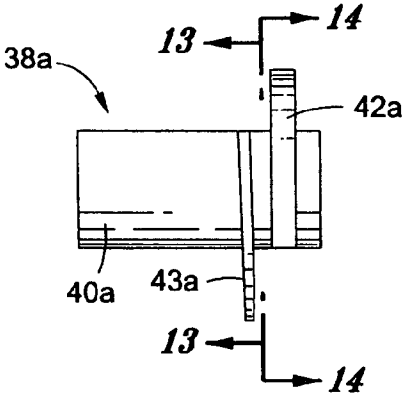
FIG. 11 is a side elevational view of an alternative embodiment of the rotary metering device shown in FIGS. 7 and 8.
Figure 13:
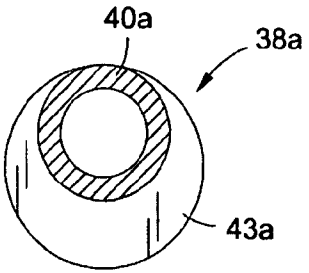
FIG. 13 is a cross-sectional view taken along line 13-13 of FIG. 11.

Referring now to FIGS. 11-14, there is shown a rotary metering device 38*a* which may be integrated into the deployment device 10 as an alternative to the above-described rotary metering device 38. The rotary metering device 38*a* comprises a tubular main body 40*a* which is sized and configured to be advanceable over the exposed end portion of a respective rod 24. Formed in the distal end of the main body 40*a* of each rotary metering device 38*a* is a slot 41*a* which is sized and configured to receive or accommodate the pin 23 of the corresponding rod 24. In this regard, the receipt of the pin 23 of each rod 24 into the complimentary slot 41*a* of the corresponding rotary metering device 38*a* ensures that the rod 24 and the rotary metering device 38*a* will rotate concurrently with each other. Formed about and protruding from one end portion of the main body 40*a* is a spaced pair of blade members 42*a*, 43*a*. As seen in FIGS. 12 and 14, the blade member 42*a* has a generally semi-circular configuration. As seen in FIGS. 12 and 13, the blade member 43*a* has a generally circular configuration, but is formed on the main body 40*a* such that the axes of the main body 40*a* and the blade member 43*a* extend in spaced, generally parallel relation to each other. As indicated above, the blade members 42*a*, 43*a* are formed on the body 40*a* in spaced relation to each other such that a relatively narrow gap (shown in FIG. 11) is defined between portions thereof, the blade members 42*a*, 43*a* further being arranged such that the blade member 43*a* is positioned between the blade member 42*a* and the slot 41*a*.

As previously explained, when the rotary metering devices 38 are included in the deployment device 10, a first diametrically opposed pair of such rotary metering devices 38 are preferably rotated in a different rotational direction than the remaining diametrically opposed so as to prevent the rotary metering devices 38 from actually rotating the stack of SM foils 21. However, if the alternately configured rotary metering devices 38*a* are integrated into the deployment device 10, the need to rotate one diametrically opposed pair of the rotary metering devices 38*a* in a first direction while rotating the remaining diametrically opposed pair in a second, opposite direction to prevent rotation of the stack of SM foils 21 is effectively eliminated due to the above-described structural attributes of the rotary metering devices 38*a*. More particularly, such differing rotational directions are not needed since the blade members 42*a*, 43*a* of each rotary metering device 38*a* have no helix angle. Therefore, even if the SM foils 21 of the corresponding stack do rotate, there is no effect on metering. Those of ordinary skill in the art will recognize that further alternate embodiments of the rotary metering devices are contemplated to be within the spirit and scope of the present invention.

The initial loading of the stackable SM foils 21 into the interior chamber 20 of the canister 12 is made easier by the absence of any jack screw extending directly along the axis A of the interior chamber 20. Additionally, the dispensation of the SM 21 foils from the canister 12 is assisted by the guide tabs 46 of the corresponding support plate 44.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process, may be implemented by one skilled in the art in view of this disclosure.

What is claimed is:

1. A deployment device for stacks of foils, comprising:

at least one canister including:

an elongate, tubular housing defining opposed forward and aft ends, and having an interior chamber which extends at least partially therethrough along an axis and defines a generally circular cross-sectional configuration;

four elongate, rotatable drive members, each of the drive members including an elongate externally threaded rod, the drive members extending along the interior chamber in equidistantly spaced intervals of approximately 90°, in generally parallel relation to the axis, at least two drive members disposed in diametrically opposed relation to each other, one diametrically opposed pair of the drive members configured to rotate in a clockwise direction, and the other diametrically opposed pair of the drive members configured to rotate in a counterclockwise direction, wherein each of the drive members includes a drive gear which is operatively coupled thereto and concurrently rotatable therewith, each of the drive gears being positioned proximate the forward end of the housing, the drive gears being mechanically coupled to each other by a plurality of transmission gears in a manner wherein the rotation of any one of the drive gears by a corresponding one of the drive members facilitates the concurrent rotation of all of the drive ears and thus all of the drive members at substantially equal rotational speeds;

four rotary metering devices cooperatively engaged to respective ones of the drive members and positioned proximate the aft end of the housing, the rotation of the drive members facilitating the concurrent rotation of the rotary metering devices, the rotary metering devices being cooperatively engageable to a stack of the foils disposed within the interior chamber; and a piston disposed within the interior chamber and cooperatively engaged to only a diametrically opposed pair of the drive members such that the rotation of the drive members facilitates the concurrent movement of the piston along the axis, and wherein a diametrically opposed pair of drive members do not contact the piston.

2. The deployment device of claim 1 further comprising a drive unit which is mechanically coupled to and operative to facilitate the rotation of one of the drive members.

3. The deployment device of claim 2 comprising a pair of canisters extending in side by side relation to each other, the drive unit being mechanically coupled to and operative to facilitate the rotation of one of the drive members of each of the canisters.

4. The deployment device of claim 1 further comprising an end cap which is pivotally connected to the housing proximate the aft end thereof, and is selectively movable between a closed position wherein the interior chamber is enclosed and sealed thereby, and an open position wherein the interior chamber is open to atmosphere at the aft end of the housing.

5. A deployment device for stacks of foils, comprising:

at least one canister including:

an elongate, tubular housing defining opposed forward and aft ends, and having an interior chamber which extends at least partially therethrough along an axis;

four elongate, rotatable drive members, each of the drive members including an elongate externally threaded rod, the drive members extending along the interior chamber in spaced intervals of approximately 90°, in generally parallel relation to the axis, at least two drive members disposed in diametrically opposed relation to each other, one diametrically opposed pair of the drive members configured to rotate in a clockwise direction, and the other diametrically opposed pair of the drive members configured to rotate in a counterclockwise direction, wherein each of the drive members includes a drive gear which is operatively coupled thereto and concurrently rotatable therewith, each of the drive gears being positioned proximate the forward end of the housing, the drive gears being mechanically coupled to each other by a plurality of transmission gears in a manner wherein the rotation of any one of the drive gears by a corresponding one of the drive members facilitates the concurrent rotation of all of the drive gears and thus all of the drive members at substantially equal rotational speeds;

four rotary metering devices cooperatively engaged to respective ones of the drive members and positioned proximate the aft end of the housing, the rotation of the drive members facilitating the concurrent rotation of the rotary metering devices, the rotary metering devices being cooperatively engageable to a stack of the foils disposed within the interior chamber; and a piston disposed within the interior chamber and cooperatively engaged to only a diametrically opposed pair of the drive members such that the rotation of the drive members facilitates the concurrent movement of the piston along the axis, and wherein a diametrically opposed pair of drive members do not contact the piston.

* * * * *